US006293546B1

(12) United States Patent
Hessing et al.

(10) Patent No.: US 6,293,546 B1
(45) Date of Patent: Sep. 25, 2001

(54) REMOTE CONTROLLER DEVICE FOR SHUFFLING MACHINE

(75) Inventors: Lynn Hessing; Daniel Mahoney, both of Boise, ID (US); Steven J. Blad, Las Vegas, NV (US)

(73) Assignee: Casinovations Incorporated, Las Vegas, NV (US)

( * ) Notice: Subject to any disclaimer, the term of this patent is extended or adjusted under 35 U.S.C. 154(b) by 0 days.

(21) Appl. No.: 09/392,108

(22) Filed: Sep. 8, 1999

(51) Int. Cl.[7] ..... A63F 1/12

(52) U.S. Cl. ..... 273/138.2; 273/138.1; 273/148 R; 273/149 R

(58) Field of Search ..... 273/138.2, 138.1, 273/148 R, 149 R, 149 P, 141 A

(56) References Cited

U.S. PATENT DOCUMENTS 5,474,295 * 12/1995 Demshuk ..... 273/141 A
5,810,355 * 9/1998 Trilli ..... 273/149 R

FOREIGN PATENT DOCUMENTS

4108829-A1 * 9/1991 (DE) ..... 273/143 R
4205098-A1 * 9/1993 (DE) ..... 273/138 A

* cited by examiner

*Primary Examiner*—Benjamin H. Layno
(74) *Attorney, Agent, or Firm*—Siemens Patent Services, LC

(57) ABSTRACT

A remote control unit for remotely communicating at least one operator-selected command to a shuffling machine. The remote control unit includes a housing, a controller disposed within the housing, a display in electrical communication with the controller, and at least one user-operated key in electrical communication with the controller for electrically communicating a shuffle command to said shuffling machine. The controller includes circuitry that electrically communicates signals to the shuffling machine.

23 Claims, 6 Drawing Sheets

REMOTE CONTROLLER DEVICE FOR SHUFFLING MACHINE

FIELD OF THE INVENTION

The present invention relates to the field of automatic shuffling machines, and more particularly to a remote control unit for an automatic shuffling machine.

BACKGROUND OF THE INVENTION

Casinos, cardrooms and other gaming establishments employ many card dealers. The dealers shuffle cards, deal the cards, take bets, and otherwise play the card game. Substantial amounts of the dealer's time is spent in just shuffling the decks of cards in preparation for the ensuing card hands. During the time the dealer is shuffling, the game table is inactive, and bets are not being placed. From the standpoint of the casino, it is desirable to minimize the time spent in preparing the card decks for additional play.

A number of prior art card deck shuffling machines have been invented. Most of the prior automatic shufflers have suffered from various problems. Many are relatively slow and do not help the basic problem encountered by the gaming establishment. Others are relatively complex and thus expensive to build and maintain.

Furthermore, with respect to prior art shufflers, the control panel that the dealer must operate to start, stop etc. the shuffler is located directly on the shuffler. Because of the orientation of many tables in casinos, cardrooms, etc., it is inefficient and burdensome for the dealer to have to turn and press the buttons on the shuffler. Also, the number of buttons and commands associated therewith on many prior art shufflers are limited.

Thus there remains a strong need for a controller for a shuffling machine that can be operated remote from the shuffling machine.

SUMMARY OF THE PREFERRED EMBODIMENTS

In accordance with one aspect of the present invention, there is provided a remote control unit for remotely communicating at least one operator-selected command to a shuffling machine. The remote control unit includes at least one key for remotely communicating commands, such as start shuffling, to the shuffling machine. The remote control unit also includes a controller in electrical communication with the key(s) for communicating the commands to the shuffling machine. The remote control unit also includes a display in electrical communication with the controller for displaying output information to the operator.

In accordance with another aspect of the present invention there is provided a remote control unit in communication with a shuffling machine. In a preferred embodiment the remote control unit includes a cord having a first end connected to the remote control unit and a second end connected to the shuffling machine. The cord includes circuitry that communicates the remote control unit and the shuffling machine. In other preferred embodiments the cord is omitted, and commands are communicated via infrared or radio frequency transmitter/receivers.

In accordance with yet another aspect of the present invention, there is provided a method for operating an electronic playing card shuffling machine. The method includes the steps of locating a control unit remote from the shuffling machine, and operating the control unit to cause the shuffling machine to perform at least one function.

Other objects, features and advantages of the present invention will become apparent to those skilled in the art from the following detailed description. It is to be understood, however, that the detailed description and specific examples, while indicating preferred embodiments of the present invention, are given by way of illustration and not limitation. Many changes and modifications within the scope of the present invention may be made without departing from the spirit thereof, and the invention includes all such modifications.

BRIEF DESCRIPTION OF THE DRAWINGS

The invention may be more readily understood by referring to the accompanying drawings in which.

Like numerals refer to like parts throughout the several views of the drawings.

DETAILED DESCRIPTION OF THE PREFERRED EMBODIMENTS

Figure 1:
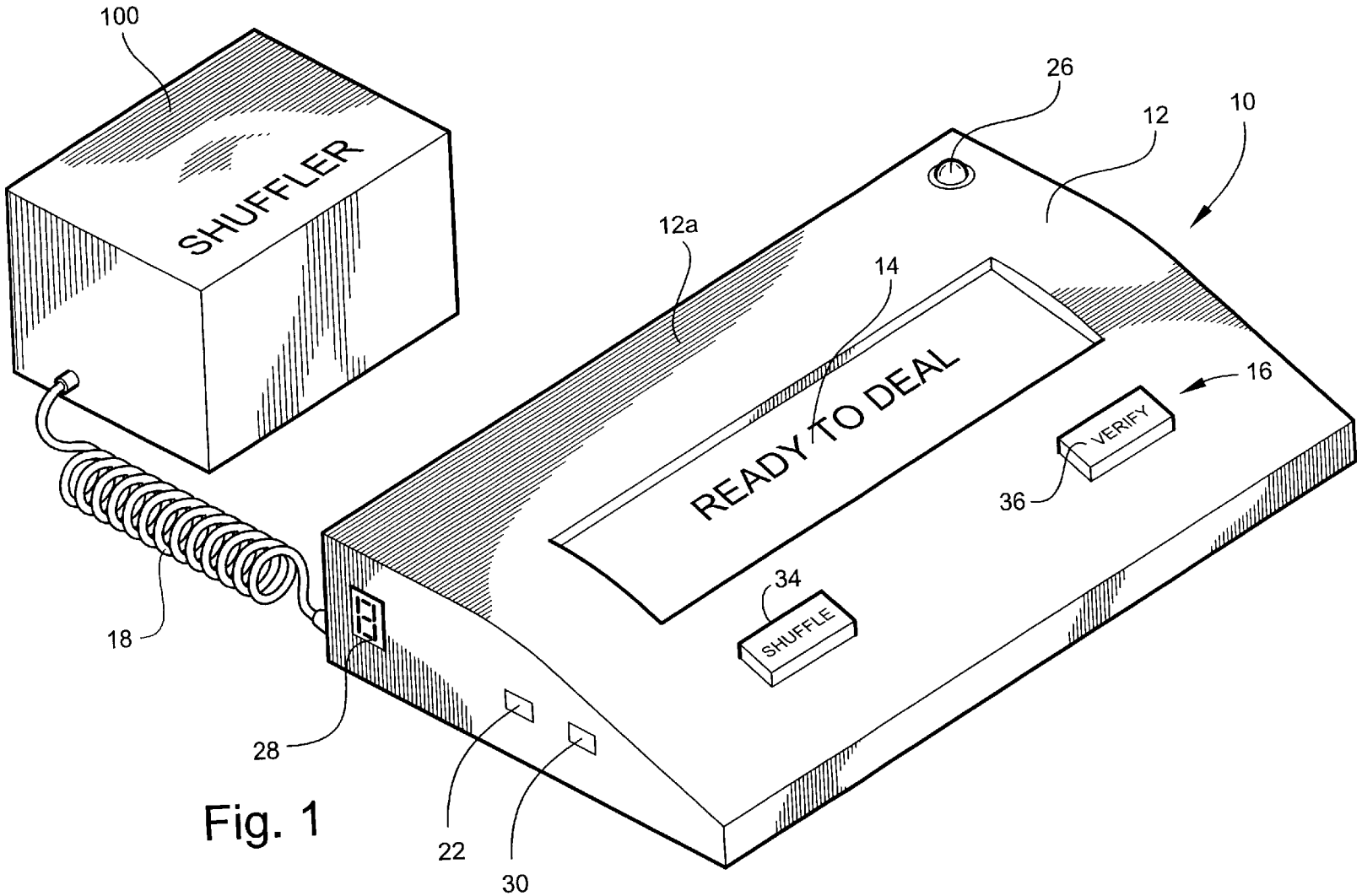
FIG. 1 is a perspective view of a remote control unit in accordance with a first embodiment of the present invention.

With reference generally to FIGS. 1–6, a preferred embodiment of a remote control unit 10 for a playing card shuffling machine 100 is shown. The present invention provides a remote control unit 10 that can be used with a cooperative automatic playing card shuffling machine 100. The unit 10 controls the various functions of the shuffler 100, for example, without limitation, the manner of shuffling, whether the shuffler is in batch or continuous mode; the card game to be shuffled for or dealt, such as Pai-Gow poker, black jack, etc. (it will be understood that the type of card game is not a limitation on the present invention); the security measures of the shuffler, such as verifying the number of cards in the deck. The remote control unit 10 generally includes a housing 12, a display 14, a control panel 16, a cord 18 for connecting the remote controller 10 to a shuffling machine 100, and a controller 20. It will be appreciated that terms such as "top," "bottom" and "side" used hereinbelow are used merely for ease of description and refer to the orientation of the components as shown in the Figures. It should be understood that any orientation of the elements of the remote control unit 10 described herein is within the scope of the present invention. It will be further understood that playing card shuffling machines are known in the art. For example, U.S. application Ser. No. 08/847,232, filed May 1, 1997, which is incorporated herein by reference, discloses a playing card shuffling machine.

Figure 2:
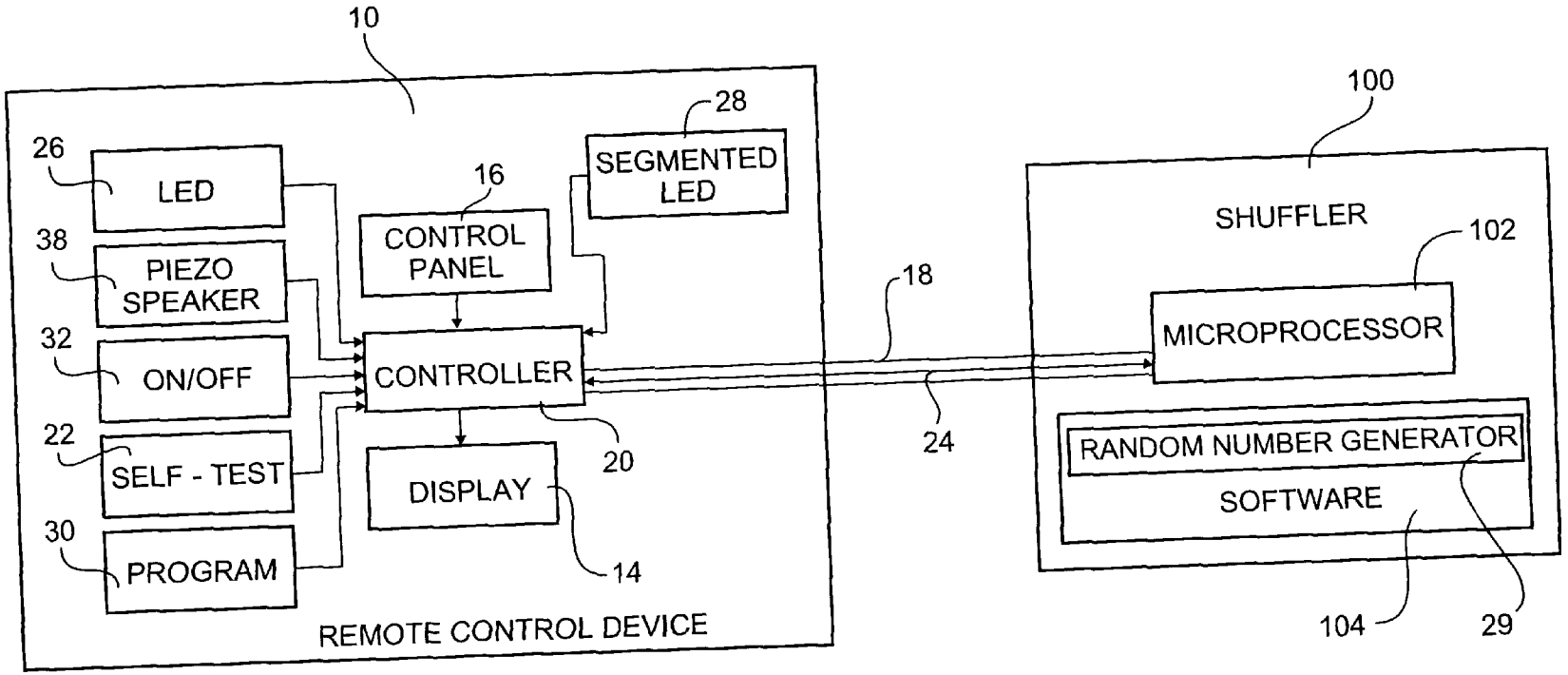
FIG. 2 is a diagrammatic view of the invention showing various components of the remote control unit of FIG. 1 and a shuffler.

As shown in FIGS. 1 and 2, the housing 12 includes a face 12*a* in which is defined a plurality of openings for display 14 and control panel 16. Control panel 16 includes at least one key, and preferably a plurality of keys that are in electrical communication with controller 20. The keys transmit electrical signals that are associated with predetermined commands to controller 20, which in a preferred embodiment of the present invention is a serial interface board. It will be understood that any microprocessor interface can be used including direct extension of the interface bus. Controller 20 then transmits the appropriate signal to a microprocessor 102 associated with the shuffler 100 via circuitry 24. In a preferred embodiment, controller 20 transmits an interrupt command to the microprocessor 102, so that the present function being performed by the shuffler 100 is interrupted, and the command signal resulting from the pressing of a key is transmitted to the shuffler 100. Keys can be programmed to communicate any desired command, for example, on/off, stop shuffling, start shuffling, verify, program, number of players, etc. Individual key operation will be described more fully hereinbelow. Other keys in electrical communication with controller 20 may be included on the side or bottom of the housing 12. For example, in a preferred embodiment, a "service" key 22 may be included on the side or bottom of the unit 10. When the "service" key 22 is pressed the unit 10 cycles through a series of different self tests for testing the sensors and functions of the shuffler 100. The operator can choose the desired self test. Also, in a casino, a certain table is typically designated for a single game. Therefore, the type of game to be dealt is not often changed. It may be desirable therefore to include the key/button that controls which game is being played (program key 30; described below) on the side or bottom of the unit. Also, any of the keys may be inset in the housing so that it is difficult to access and cannot be accidentally depressed.

Preferably, the housing 12 is made of sheet metal (such as aluminum), durable plastic or other tough, durable material. The keys are preferably tactile feedback keys, and include indicia thereon for identifying the command the key communicates to the microprocessor 102. The keys can also be made of silicon rubber-carbon as is typical for such keys, or the key pad can be a membrane key pad. Controller 20 (and ultimately microprocessor 102) controls the operation of the remote control unit 10 by accepting input data from control panel 16, displaying output data on display 14, and transmitting and receiving commands and data through cord 18 to and from shuffler 100. In a preferred embodiment, display 14 is a backlit liquid crystal display (LCD). However, it will be understood that other display technologies known in the art, for example, vacuum florescent, flat panel display, segmented LED's, are within the scope of the present invention.

Figure 6:
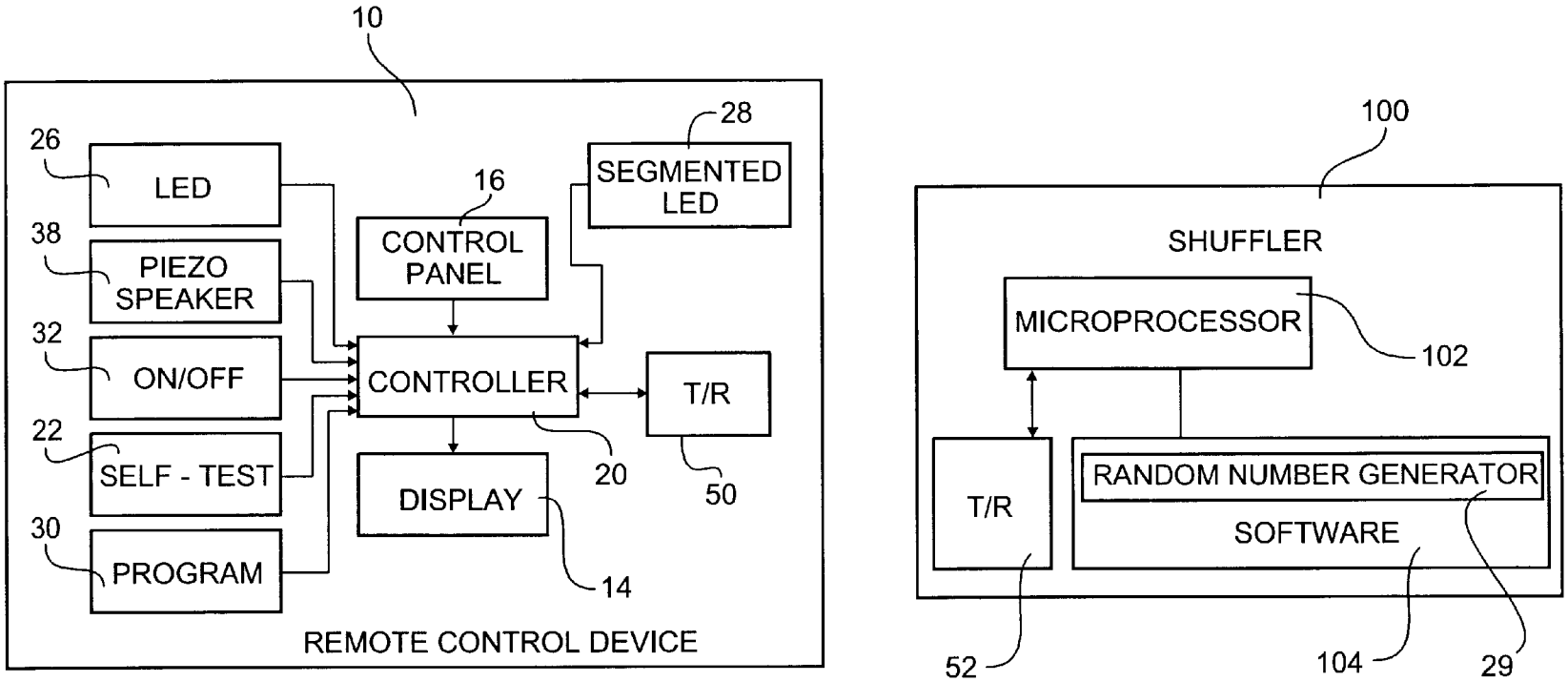
FIG. 6 is a diagrammatic view of the invention similar to FIG. 2 that includes a pair of transmitter/receivers.

The operation of selected commands associated with the keys, switches or buttons of the remote control unit 10 will now be described. It will be understood that any of the keys can be included anywhere on the unit 10, including in the control panel 16. The control panel 16 being the key(s) located on the face 12*a* of the housing 12 that are typically used most often. Preferably the unit 10 is powered by the shuffler 100, i.e., power is transmitted from the shuffler 100 through cord 18 to the unit 10. In another embodiment, the remote control unit 10 may include an "on/off" key 32 in communication with controller 20 for turning power to the remote control unit 10 on and off. The remote control unit 10 can also be powered by batteries or an AC power cord that is communicated directly with the shuffler from an AC outlet. It will be understood that the on/off switch can be located anywhere on the unit 10 or the shuffler 100. For example, the on/off switch 32 may be a rocker-type switch located on the back panel of the unit 10 (as shown in FIG. 6). The on/off key 32 can be any latchable pushbutton switch.

The remote control unit 10 can also include a "menu" key 30. The program key 30 allows the operator to select the type of card game to be played, for example, without limitation, Pai-Gow Poker, Caribbean Stud, Let It Ride, Black Jack, etc. Different card games require different shuffling and/or dealing methods. When the program key 30 is depressed, the name of a card game appears on the display 14. The operator can cycle through the different games programmed into the microprocessor's memory by repeatedly pressing the program key 30 until the desired game is selected. In an alternative embodiment, the unit 10 can include separate keys 22 for each different card game.

The unit 10 can include a "verify" key 36. The verify key 36 is provided so that the operator can verify the number of cards that are in the deck at a desired time. The verify key 36 only operates when pressed at the end/beginning of a game/dealing sequence. If the verify key 36 is pressed during a game, it will be ignored. Via the microprocessor 102, the unit 10 keeps track of the number of cards that have been dealt during a dealing sequence. After a game, when the verify key 36 is pressed, the remaining cards are ejected out of the shuffler 100 into the collection area and counted as they are ejected. This number is added to the number of cards that have been dealt to verify that there are a correct amount of cards in the deck (for example, 52, if one deck is being used). If the number of cards counted is incorrect the dealer is notified, for example, by a phrase on the display 14, flashing of an LED 26 (described below), and/or an audible sound.

Figure 3:
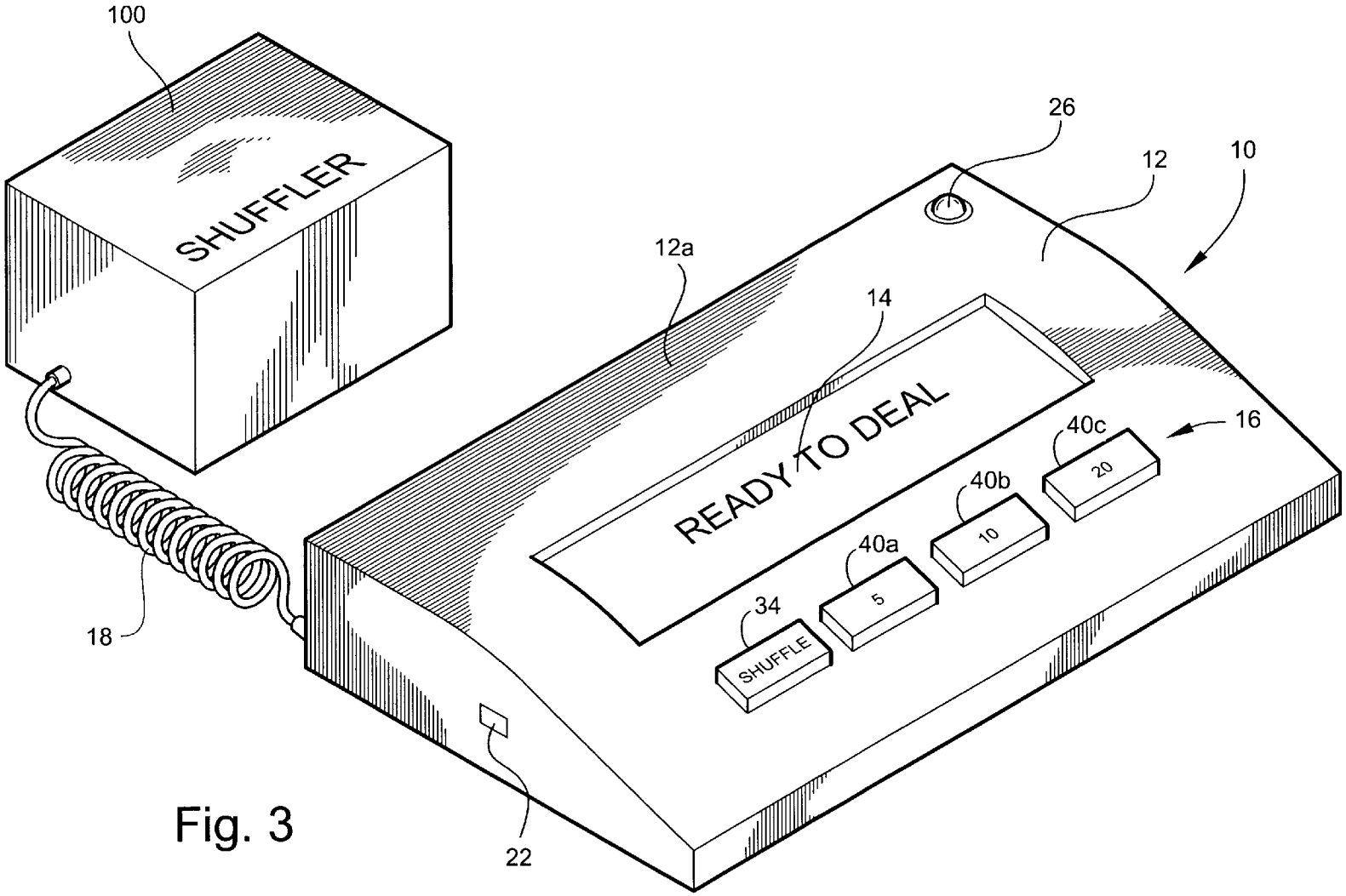
FIG. 3 is a perspective view of a remote control unit in accordance with a second embodiment of the present invention.

The unit 10 can also include a key or keys that prompt the shuffler 100 to deal a certain number of cards (designated "5," "10" and "20" 40*a*, 40*b*, 40*c* in FIG. 3, although it will be understood that any number is within the scope of the present invention). For example, in black jack, it is never known how many cards will be dealt during a game. Therefore, after the initial hands are dealt, depending on the number of players at the table and their present hands, the dealer may estimate that he/she will need 10 more cards. Therefore, he/she can press the "10" key 40*b* and the shuffler 10 will eject 10 more cards.

Figure 5:
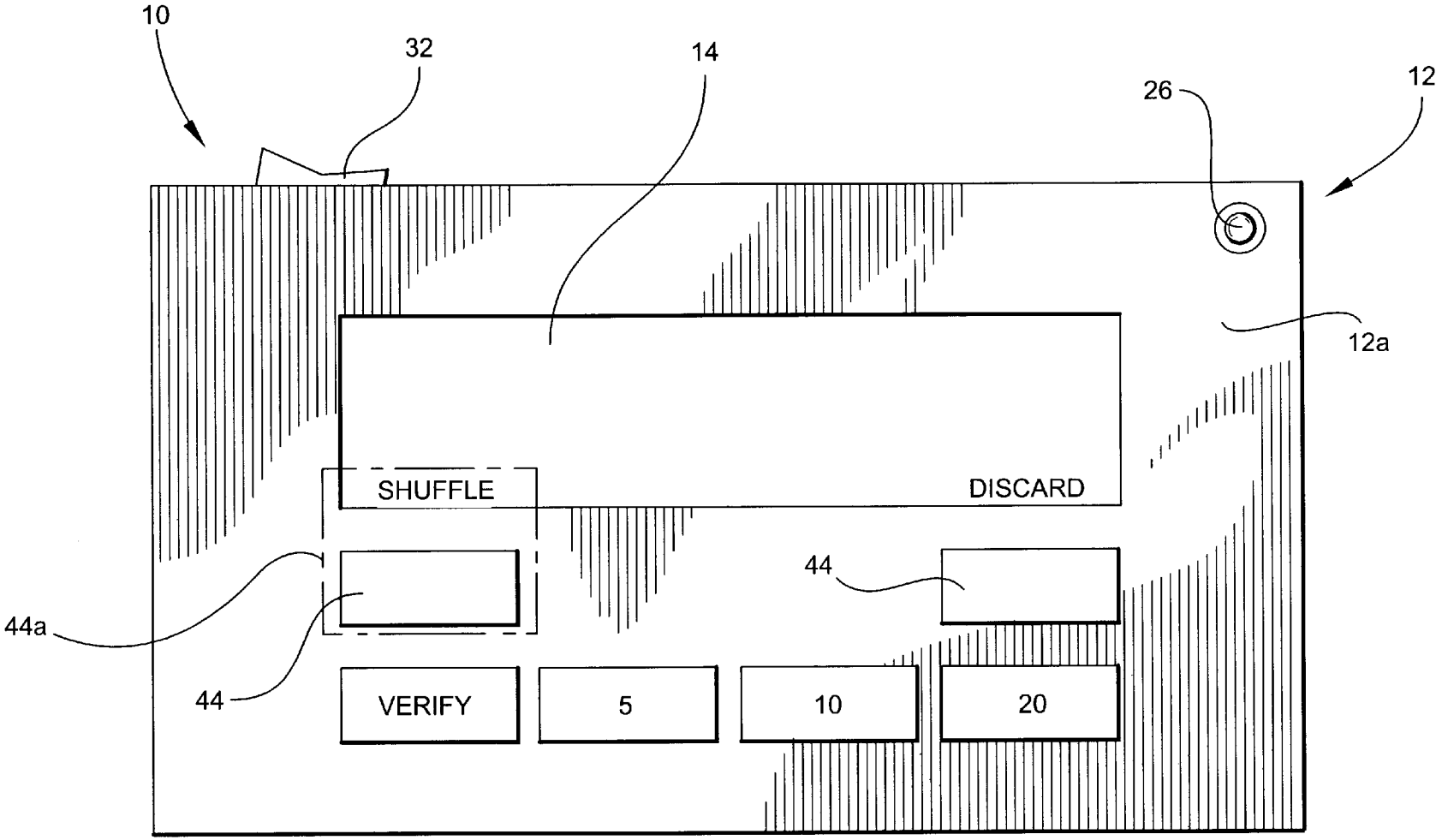
FIG. 5 is a top plan view of a remote control unit in accordance with another embodiment of the present invention showing the display and the control panel having soft keys.

As shown in FIG. 1, in a first embodiment of the present invention, the remote control unit 10 includes a rocker type on/off switch 32 (as shown in FIG. 5) located on the rear panel, a "service" key 22 and "menu" key 30 on a side panel, and a control panel 16 that includes a "shuffle" key 34 and a "verify" 36 key. It will be understood that the "shuffle" can be marked "deal," "go" or any other word or phrase that indicates that the shuffler 100 is to initiate a card shuffle.

As shown in FIG. 3, in a second embodiment of the present invention, the remote control unit 10 includes a rocker type on/off switch 32 (as shown in FIG. 5) located on the rear panel, a "service" key 22 on a side panel, and a control panel 16 that includes a "shuffle" key 34 and "5," "10" and "20" keys 40*a*, 40*b*, 40*c*. This embodiment is preferably used with a shuffler operating in continuous mode.

Figure 4:
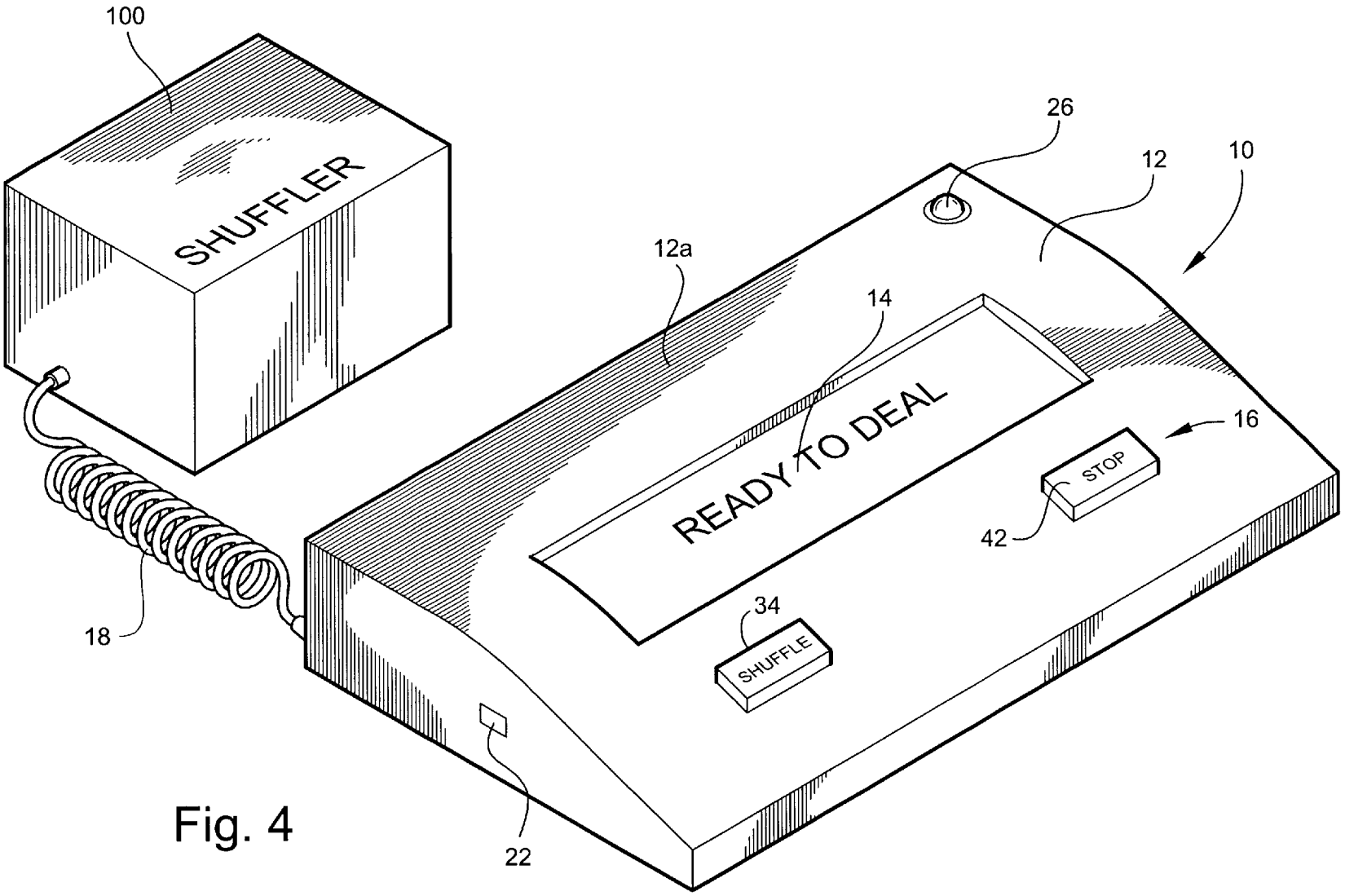
FIG. 4 is a perspective view of a remote control unit in accordance with a third embodiment of the present invention.

As shown in FIG. 4, in a third embodiment of the present invention, the remote control unit 10 includes a rocker type on/off switch 32 (as shown in FIG. 5) located on the rear panel, a "service" key 22 on a side panel, and a control panel 16 that includes a "shuffle" key 34 and a "stop" key 42. This embodiment is preferably used with a shuffler operating in batch mode.

It will be understood that the microprocessor 102 can be associated with software 104 that allows the shuffler 102 to be used in any of the applications referenced herein.

The unit 10 can also include other keys, such as "number of players," or a key that enters the number of cards that have been dealt to each player or a key for selecting the mode of the shuffler, namely, continuous mode, batch mode or specialty game mode. The functions of the various keys, switches or buttons recited herein are intended to be merely exemplary, and those skilled in the art will be able to make numerous modifications and additions to them without departing from the spirit of the present invention. Moreover, various keys may be soft keys 44, the function of which is defined by the bottom line on the display 14. This is indicated in FIG. 5 by box 44*a*. The soft keys 44 are preferably located on the top row of the control panel 16 and are adjacent to the display 14. The function of the soft keys 44 may change, for example, with the type of game that is selected. This allows for a plurality of functions to be performed while minimizing the number of keys needed.

Referring again to FIGS. 1–2, the remote control unit 10 is programmed to communicate appropriate signals to the display 14 to indicate to the operator what function is being performed by the shuffler 100, or what function should be performed next by the operator. For example, while the shuffler 100 is shuffling, the word "running" appears on the display. After shuffling is complete, the phrase "selected game is . . . ") appears on the display 14, as shown in FIG. 1. In another embodiment, the microprocessor 20 can be programmed with different languages, such as French, Spanish, Italian, etc. A key can be included for cycling through the various language choices.

In operation, when any key, switch or button is activated by depressing, switching or the like, a signal is electrically transmitted to controller 20. A predetermined command is transmitted then from the controller 20 to the shuffler 100 via transmission means. The shuffler 100 then performs the function associated with the command. As described above, the transmission means can be a cord 18, including circuitry 24, connected at one end to the remote control unit 10 and at its opposite end to the shuffler 100. However, remote control unit 10 can interface with shuffler 100 in a number of different ways. For example, cord 18 can be omitted, thereby allowing "cordless" operation of remote control unit 10 and providing greater freedom of movement of the remote control unit 10. As shown in FIG. 5, the "cordless" remote control unit 10 includes a transmitter/receiver "T/R" 50 to send commands and data to transmitter/receiver "T/R" 52, which is located on the shuffler 100. The transmitter/receivers 50, 52 can be an infrared transmitter/receivers or a radio frequency transmitter/receiver that include associated antennas.

In a preferred embodiment, the remote control unit 10 includes an indicator for indicating an error condition. Preferably, the back light of the display 14 flashes to indicate an error condition. In another embodiment, the indicator is a light emitting diode (LED) 26 mounted at a location on the remote control unit. The LED 26 is electrically connected to controller 20 to indicate an error condition. Such error conditions may include, but are not limited to, malfunction of the shuffler, such as a mis-shuffle or a jam in the shuffler, a failure in the electronics, bad deck count, i.e., too many or too few cards in the deck (see the description of the "verify" key above), empty supply tray, etc. When the controller 20 receives an error signal, the controller 20 communicates a signal to the LED 26, thereby activating the LED 26 to indicate the error condition to the operator. Preferably, the display 14 indicates to the operator what the error condition is. In a preferred embodiment, the unit 10 includes a device for emitting an audible signal when an error condition is detected. For example, a speaker 38 such as an electromagnetic, electro magnetic or piezoelectric speaker or the like that emits a beep or buzz when an error condition is detected. Preferably the electromagnetic speaker 38 is in communication and cooperates with the LED 26.

Referring to FIGS. 1 and 2, preferably, the remote control unit 10 is programmed to provide commands to the shuffler 100 to shuffle and deal for the game Pai-Gow poker. As will be appreciated by those skilled in the art, in Pai-Gow poker, seven hands are always dealt, and the player that goes first is chosen by chance. Typically the player to be dealt to first is chosen by rolling dice. In a preferred embodiment, the present invention includes a segmented LED 28, as shown in FIG. 1 that is electrically connected to the microprocessor 102 in shuffler 100, which includes within the software 104 a random number generator 29. In operation, when the remote control unit 10 is prompted by the operator to command the shuffler 100 to shuffle and deal a game of Pai-Gow poker, the random number generator generates a number between 1 and 7. The number is then electrically communicated to and displayed on the segmented LED 28. Preferably a segmented LED 28 is located on both sides of the remote control unit 10 so that all players sitting around a semi-circular table can see the number. It will be understood that the segmented LED(s) can be located anywhere on the housing 12 of remote control unit 10. Furthermore, the number generated by the random number generator 29 can be displayed on the display 14, as well as the segmented LED 28, or on the display 14 alone. In an alternative embodiment, the random number generator can be associated with the remote control unit 10.

In a preferred embodiment, the shuffler 100 includes a switch or key for turning on and off the random number generator option. Therefore, when the random number generator is switched off, a game of Pai-Gow poker can be dealt without generating a random number.

The embodiments of the present invention recited herein are intended to be merely exemplary, and those skilled in the art will be able to make numerous modifications to them without departing from the spirit of the present invention. For example, the unit may have the keys omitted and include a touch-sensitive display. All such modifications are intended to be within the scope of the present invention as defined by the claims appended hereto.

What is claimed is:

1. A remote control unit for remotely communicating at least one operator-selected command to a shuffling machine adapted to randomly rearrange the cards within at least one deck of playing cards, said remote control unit comprising a display for displaying output information to an operator.

2. The remote control unit of claim 1 comprising at least one key for remotely communicating said at least one command to said shuffling machine.

3. The remote control unit of claim 2 further comprising a controller in electrical communication with said at least one key, said controller for communicating said at least one command to said shuffling machine.

4. The remote control unit of claim 3, wherein said controller is in electrical communication with said display.

5. The remote control unit of claim 2 wherein said at least one key communicates a shuffle command to said shuffling machine.

6. The remote control unit of claim 3 comprising a plurality of keys for remotely communicating commands to said shuffling machine.

7. The remote control unit of claim 6 comprising a key that communicates a shuffle command to said shuffling machine, and a key that communicates a verify command to said shuffling machine.

8. The remote control unit of claim 3 wherein said controller is in electrical communication with an indicator disposed in said remote control unit, wherein said indicator indicates to an operator that an error condition exists.

9. The remote control unit of claim 8 wherein said indicator is a light emitting diode.

10. The remote control unit of claim 8 wherein said indicator is a device that emits an audible sound.

11. The remote control unit of claim 9 wherein said indicator further comprises a device that emits an audible sound.

12. The remote control unit of claim 6 comprising a program key that allows an operator to select a desired card game to be dealt.

13. The remote control unit of claim 6 further comprising a random number generator in electrical communication with said controller.

14. The remote control unit of claim 13 further comprising a segmented LED in electrical communication with said random number generator.

15. The remote control unit of claim 1 in communication with a shuffling machine.

16. The remote control unit of claim 15 further comprising a cord having first and second opposite ends, wherein said first end is connected to said remote control unit and said second end is connected to said shuffling machine and wherein said cord includes circuitry that facilitates communication between said remote control unit and said shuffling machine.

17. The remote control unit of claim 15 wherein said remote control unit and said shuffling machine each include a respective transmitter/receiver for communication therebetween.

18. The remote control unit of claim 17, wherein said respective transmitter/receivers are radio frequency transmitter/receivers.

19. The remote control unit of claim 17, wherein said respective transmitter/receivers are infrared transmitter/receivers.

20. A method for operating an electronic playing card shuffling machine, the method comprising the steps of:

(a) locating a control unit remote from said shuffling machine, said control unit comprising a display for displaying output information to an operator, and (b) operating said control unit to cause said shuffling machine to perform at least one function.

21. The method of claim 20 wherein said at least one function is shuffling cards.

22. The method of claim 20 wherein said at least one function is verifying a number of cards in a deck.

23. A remote control unit for a shuffling machine comprising:

(a) a housing, (b) a controller disposed within said housing, (c) a display in electrical communication with said controller, said controller including circuitry that electrically communicates signals to said shuffling machine, and (d) at least one user operated key in electrical communication with said controller for electrically communicating a shuffle command to said shuffling machine.

* * * * *